United States Patent [19]

Yuito

[11] Patent Number: 4,949,607

[45] Date of Patent: Aug. 21, 1990

[54] CONTROL SYSTEM FOR WEB MATERIAL CUTTING LINE

[75] Inventor: Fumio Yuito, Shizuoka, Japan

[73] Assignee: Fuji Photo Film Co., Ltd., Kanagawa, Japan

[21] Appl. No.: 335,680

[22] Filed: Apr. 10, 1989

[30] Foreign Application Priority Data

Apr. 8, 1988 [JP] Japan ..... 63-86692

[51] Int. Cl.[5] ..... B26D 5/40

[52] U.S. Cl. ..... 83/76.7; 83/371; 83/364; 83/367; 364/474.09

[58] Field of Search ..... 83/71, 360, 371, 364, 83/367, 370, 105, 106; 364/474.09

[56] References Cited

U.S. PATENT DOCUMENTS

| | | | |
|---|---|---|---|
| 3,169,428 | 2/1965 | Owen | 83/371 |
| 3,407,690 | 10/1968 | Stanley | 83/371 |
| 3,646,789 | 3/1972 | Forster | 83/371 |
| 4,034,973 | 7/1977 | Hams | 83/371 |
| 4,809,573 | 3/1989 | Welch | 83/71 |

FOREIGN PATENT DOCUMENTS 60-135111 7/1985 Japan .

*Primary Examiner*—Frank T. Yost
*Assistant Examiner*—Hwei-Siu Payer
*Attorney, Agent, or Firm*—Young & Thompson

[57] ABSTRACT

A control system for a web cutting line has a cutter for cutting a web of indeterminate length advanced along a web cutting line into sheets, and an end cutting shear for severing that part of the web that extends along the web cutting line from the major or upstream part of the web that has not yet reach the cutting line. A first defect sensor is disposed near the end cutting shear for detecting surface defects in the web, and a second defect sensor is disposed near the first-mentioned cutter for detecting a defective part of the web that includes a surface defect. The number of acceptable sheets that is expected to be obtainable from that part of the web that extends along the cutting line is estimated, based on the distribution of surface defects detected by the first defect sensor, and the number of acceptable sheets already cut off from the web is added to this estimated number. The end cutting shear is actuated to cut off that part of the web extending along the cutting line when the sum of the estimated number and the counter number of acceptable sheets reaches a prêdetermined total.

7 Claims, 2 Drawing Sheets

CONTROL SYSTEM FOR WEB MATERIAL CUTTING LINE

BACKGROUND OF THE INVENTION

The present invention relates to a control system for a web material cutting line, and more particularly to a control system for controlling the cutting of web material of indeterminate length into sheets of predetermined length.

In continuous web material cutting lines having a so-called payoff or supply reel for supplying elongated narrow web material, and a web shearing or cutting device located near the forward or downstream end of the cutting line for cutting of the web material to sheets of predetermined length, there are provided, between the supply reel and the web cutting device, various devices and instruments, such as a side trimmer for trimming the sides of the web material, a leveler for holding the traveling web material flat, a thickness meter, a pin-hole detector and other inspection devices. Such a web cutting line needs a substantial distance between the supply reel and the web cutting device. When stopping the cutting of the web with a great part of the web material remaining on the supply reel, it is quite hard to rewind the web material in the cutting line on the supply reel.

Some of such web material cutting lines are provided with shearing or cutting devices for cutting off that part of the web material remaining along the cutting line after stoppage. Such a cutting device (which is hereinafter referred to as an end cutting shear) is located near the entrance of the cutting line through which the web material is introduced to the cutting line. The desired number of standard sheets obtainable from that part of the web which is disposed along the cutting line is estimated, based on an effective or acceptable rate. When the sum of the estimated number of possible acceptable sheets and the number of cut off sheets reaches a predetermined total or desired number of sheets, the end cutting shear is actuated to cut off that part of the web that is still disposed along the cutting line. Such a control system has been disclosed in Japanese Unexam. Patent Publ. No. 60-135,111.

If an accurate number of acceptable or standard sheets is to be obtained, a highly reliable effective acceptable rate must be used. To provide a reliable rate, it is necessary to run the web cutting line for quite a long period of time. Therefore, it is hard to obtain a reliable rate when cutting only a small number of sheets.

OBJECT OF THE INVENTION

It is, therefore, a primary object of the present invention to provide a control system for a cutting line for web material of indeterminate length, in which a predetermined total number of sheets can be cut from a web with high accuracy.

SUMMARY OF THE INVENTION

The above object of the present invention is achieved by providing a web cutting line equipped with a control system according to the present invention having cutting means for cutting a web advanced along the web cutting line to sheets of a predetermined length, and end cutter shear means disposed near an entrance of the web cutting line for severing that part of the web that extends along the web cutting line from the major part of the web, that is, from the portion of the web that has not yet entered the cutting line.

First defect sensor means is near the end cutting shear means for detecting surface defects in the web. Second defect sensing means is near the cutting means for detecting substandard or defective parts of the web that include a surface defect. Estimating means and control means cooperate with the first and second surface defect sensing means. The estimating means estimates the number of standard or acceptable sheets that can be expected to be obtainable from that part of the web that extends along the cutting line, based on the distribution of surface defects detected by the first defect sensing means. A counter cumulatively counts standard or acceptable sheets cut off from the web and the control means causes the end cutting shear means to cut off that part of the web that extends along the cutting line when the sum of the estimated number and the counted number of standard or acceptable sheets reaches a predetermined or set total. The control means causes piling means, based on outputs from the second defect sensing means, to separately direct standard or acceptable sheets, on the one hand, and substandard or defective sheets, on the other hand, to separate containers, respectively.

DETAILED DESCRIPTION OF THE INVENTION

Figure 1:
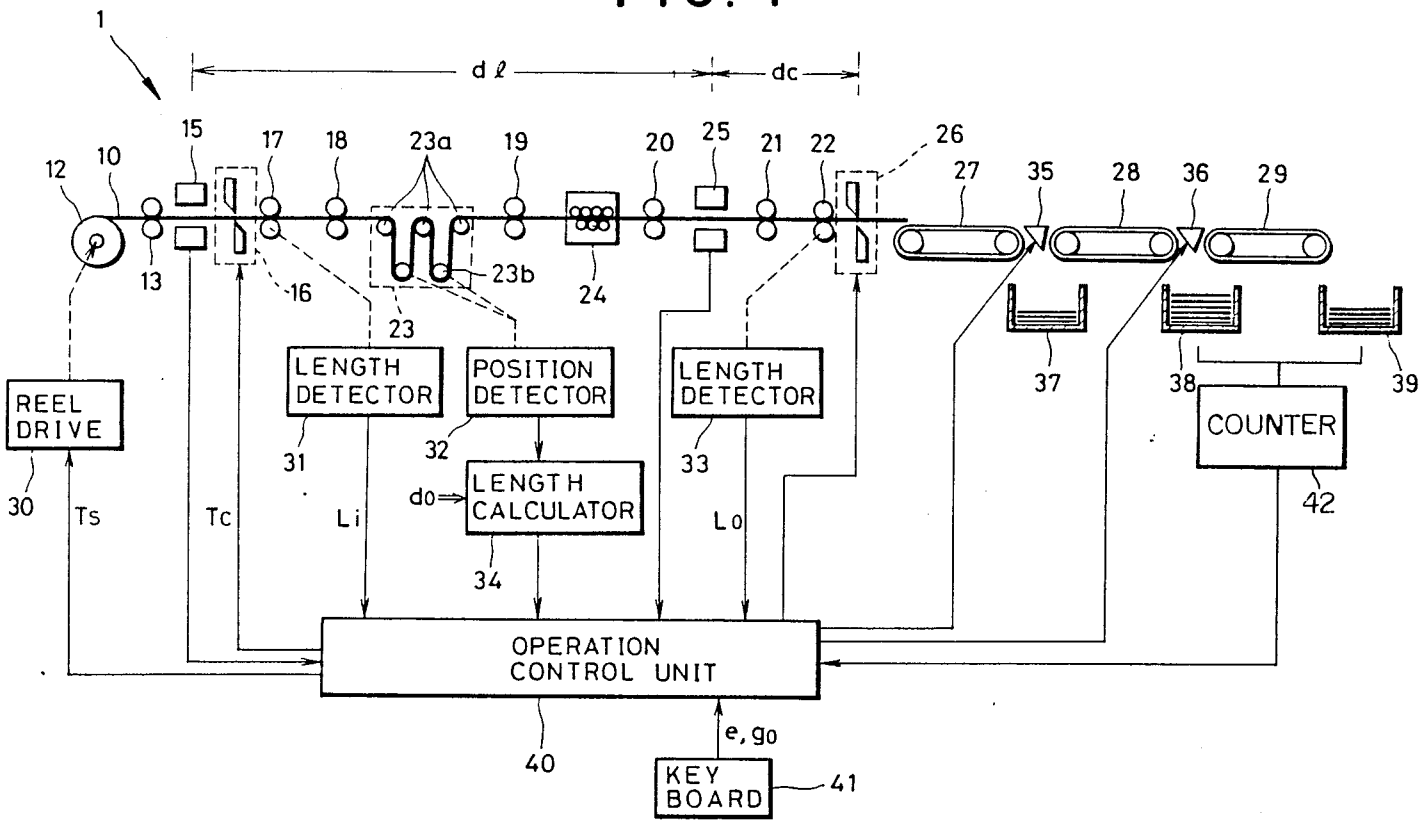
FIG. 1 is a schematic diagram illustrating a web cutting line in which a control system in accordance with the present invention is embodied.

Referring to the drawings, particularly to FIG. 1, a cutting line 1 for web of indeterminate length (which is hereinafter referred to as a cutting line) is shown, having an unwinder or supply reel 12 at one end of the cutting line 1. It is to be noted that the extent of the cutting line 1 is from a first or upstream defect sensor 15 to a downstream cutter 26 both of which are described in detail later. The supply reel 12 has wound thereon a roll of narrow web material (which is hereinafter referred to as a web) 10, from which sheets are to be cut.

A drive mechanism 30 is controlled by an operation control unit 40 to drive the supply reel 12. Drawing rolls 13 are so disposed downstream of the supply reel 12 in the cutting line as to draw the web 10 from the supply reel 12. The rolls 13 are driven by means of an electric motor (not shown) to feed the web forward into the cutting line 1. A first defect sensor 15 is located downstream of and adjacent the rolls 13 to detect surface defects, pin-holes, etc. in the web 10 so as to identify the part of the web having such defects or pin-holes. The first defect sensor 15 provides the operation control unit 40 with a signal indicating a web defect.

An end cutting shear 16 is located downstream of and close to the first defect sensor 15 to cut off from the roll of web on the reel 12 that part of the web 10 that has already entered the cutting line 1. The end cutting shear 16 is actuated by a signal $T_c$ provided by the operation control unit 40. A metering roll 17 is located close to the end cutting device 16 and is connected to an upstream metering device 31 for metering a length $L_i$ of movement of the web 10 based on the number of rotations of the metering roll 17. Feed rolls 18, 19, 20 and 21 are located at suitable spacings along the cutting line 1 in that order.

Provided between the feed rolls 18 and 19, is a reservoir 23 including in-line stationary rolls 23*a* and movable rolls 23*b*. The movable rolls 23*b* can move up and down so as to impart proper tension to the web 10. A position sensor 32 is connected to the movable rolls 23*a* to detect the movement of the rolls 23*b* so as to output corresponding signals representing the movement of the rolls 23*b*. A web length calculator 34, which contains data as to a basic length $d_o$ of web that can be laid over the cutting line 1 and receives the signals of the movement of the rolls 23*b*, calculates the length d of the web in the cutting line 1 based on the data as to the basic length $d_o$ and the signals of movement of the rolls 23*b*. A signal representing the thus-determined length d is sent to the operation control unit 40.

A leveler 24 is disposed between the feed rolls 19 and 20 to hold the web 10 flat. A second defect sensor 25, which determines whether part of the web is standard or acceptable, or is substandard or defective, is disposed between the motor driven rolls 20 and 21. Downstream of the motor driven rolls 21 there are metering rolls 22 and a cutter 26 for cutting the web to a predetermined length e of sheets. The metering rolls 22 are connected to a downstream metering device 33 for metering the transported length $L_o$ of the web 10 based on the number of rotations of one of the metering rolls 22. Data as to the transported length of web $L_o$ is sent to the operation control unit 40. The operation control unit 40 detects substandard or defective parts of the web 10 including defects detected by the second defect sensor 25 based on the transported length $L_o$ and the length dc of the web 10 extending between the second defect sensor 25 and the cutter 26 so as to detect the defective part in advance of cutting the defective part to a sheet.

Conveyors 27, 28 and 29 are located downstream of the cutter 26 beyond the cutting line 1 in order to convey sheets cut off by the cutter 26. Between each adjoining pair of conveyors 27 and 28, or 28 and 29, there is a piling gate 35 or 36, respectively. These piling gates 35 and 36 are controlled to direct sheets toward different piling positions wherein pilers or containers 37, 38 and 39 are provided, according to the judgment of the operation control unit 40. The piler 37 receives therein defective sheets, and the pilers 38 and 39 receive therein acceptable sheets. The operation control unit 40 is connected with a keyboard 41 through which data are entered as to the predetermined length e of sheet and a predetermined set number $g_o$ of acceptable sheets that should be obtained. Letting dl be the length of web between the first defect sensor 15 and the second defect sensor 25 and dc be the length of web between the second defect sensor 25 and the downstream cutter 26, the length of web d along the cutting line 1 is (dl+dc).

In operation, the supply reel 12 with a roll of the web 10 is loaded at the upstream end of the line and the leading end of the web 10 is withdrawn and nipped between the drawing rolls 13. On the other hand, the desired length of web e and the predetermined number $g_o$ of acceptable sheets are input into the operation control unit 40 through the keyboard 41. When powering the cutting line 1, all of the rolls 13 and 18 to 21 are continuously driven at a constant speed of rotation to transport the web 10 forward. At the time the leading end of the web 10 moves beyond the second defect sensor 25, the drawing rolls 13 and the feed rolls 18 are maintained at a constant speed of rotation. The remaining feed rolls 19 to 21, however, instantaneously stop after the cutter 26 is actuated and then start again to rotate but intermittently. With the forward movement of the web 10, the second defect sensor 25 inspects the web 10 by the predetermined length e to judge whether each part of the web 10 can provide an acceptable sheet and the cutter 26 cuts off the web 10 so as to provide a sheet having a length of e.

The sheets thus cut off are transported by the conveyors 27 to 29 one after another. The operation control unit 40 controls the piling gates 35 and 36 according to the results of the judgment by the second defect sensor 25 so as to sort the sheets. When a defective sheet is on the first conveyor 27, the operation control unit 40 actuates the first piling gate 35 open so as to direct the defective sheet into the piler 37. Otherwise, when an acceptable sheet is on the first conveyor 27, the first piling gate 35 is closed to pass the acceptable sheet toward the second or middle conveyor 28. Until the piler 38 is filled with sheets, the second piling gate 36 is continuously actuated to direct a sheet into the piler 38. When the piler 38 is filled with sheets, the second piling gate 36 is closed to pass the acceptable sheets toward the third conveyor 29, so as to stack them in the piler 39. The number b of acceptable sheets stacked in each piler 38, 39 is counted by means of a counter 42 which can be of any known type. The counter provides an appropriate signal representing the counted number of acceptable sheets, which is sent to the operation control unit 40 for calculating the total number of acceptable sheets.

Whereas the transportation of the web 10 is continuous at the entrance of the cutting line 1, nevertheless, the cutting of the web 10 at the cutter 26 is performed intermittently. Therefore, the web 10 will hang slack or be loose intermediate the ends of the cutting line due to the difference of the rates of movement of the web on the upstream and downstream sides of the cutting line 1. This slack in the web 10 can be taken up by the up and down movement of the rolls 23*b* of the reservoir 23. For transporting the web 10 stably, the difference of rate of movement should be maintained constant. The operation control unit 40 calculates the difference between the basic length $d_o$ and an in-line web length "dl+dc" calculated by the web length calculator 34 so as to provide and apply a difference signal to the reel drive 30. According to the difference signal, the reel drive 30 controls the speeds of rotation of the supply reel 12, the drawing rolls 13 and the feed rolls 18. The operation control unit 40 continuously monitors the cutting operation to detect the timing at which the following equation is satisfied:

$$g_o = b + \{2(dl + dc)/e\} \quad (1)$$

where $g_o$ is the desired number of acceptable sheets b is the number of acceptable sheets actually received in pilers 38 and/or 39 dl and dc are the distances shown in FIG. 1; and e is the preselected sheet length.

Figure 2:
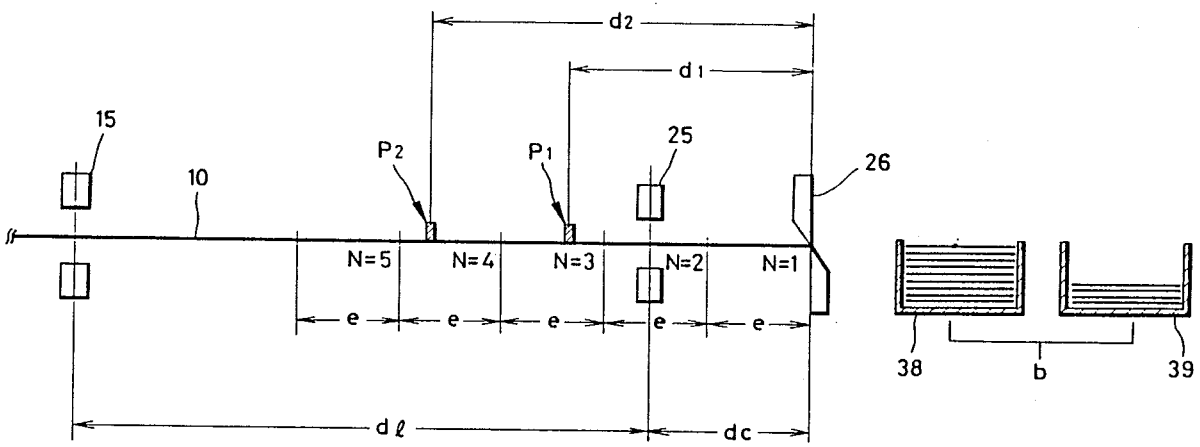
FIG. 2 is an explanatory diagram showing the estimation of the number of substandard or defective sheets expected to be obtainable from that part of the web that extends along the cutting line.

When the operation control unit 40 detects the satisfaction of this equation (1), it starts an estimate of the number of sheets obtainable from the web 10 present in the cutting line 1. This estimate will be best understood by reference to FIG. 2. The first defect sensor 15 is actuated to detect defects of the surface of the web 10 and to provide defect signals when the operation control unit 40 detects the satisfaction of the equation (1). The operation control unit 40 stores in a register thereof data as to a length Li of movement of the web 10 including surface defects, starting with the detection of a first defect signal, which length $L_i$ is calculated by the upstream metering device 31 based on the number of rotations of the roll 17. Simultaneously, the operation control unit 40 calculates the difference of length between the in-line web length "dl+dc" and the length $L_i$ of movement of the web 10 that indicates the length $d_1$ of web 10 between a position wherein the first surface defect P1 exists and the cutter 26. The length $d_2$ of web 10 between a position wherein the second surface defect P2 exists and the cutter 26 is calculated in the same manner.

The length $d_1$ is decreased every movement of the web 10 by a length e. Therefore, the relationships are as follows:

$$N.e < d_1 < (N+1).e \quad (2)$$

or $$d_l = N.e \quad (3)$$

wherein N indicates the order of a sheet of the web having the length e from the cutter 26, and $d_1$ indicates the distance between a first surface defect P1 and the cutter 26.

If the relationship (2) is satisfied, this indicates that a surface defect exists within a single division. Therefore, the number $b_n$ of defective sheets expected in the in-line length of the web 10 is estimated one. On the other hand, if the relationship (3) is satisfied, this indicates that a surface defect is on a boundary between two adjacent sheets. In this case, the number $b_n$ of defective sheets expected in the in-line length of the web 10 is estimated to be two. As to part of the web 10 at the in-line length of $d_2$, the defective number $b_n$ is estimated in the same manner. The defective number $b_n$ is estimated upon each detection of a surface defect by the first defect sensor 15 and the total number $Eb_n$ of defective sheets can be calculated.

With the movement of the web 10, the parts of the web 10 including the surface defects P1 and P2 advance along the cutting line 1, decreasing the lengths $d_1$ and $d_2$ at a same rate. When the web 10 moves a distance equal to the length $d_1$, the total number $\Sigma b_n$ of defective sheets is decremented by the number $b_n$ determined by the surface defect P1 at a distance $d_1$ from the cutter 26. As will be apparent, the total number $\Sigma b_n$ always indicates an up-dated number of defective sheets expected within a part of the web 10 extending along the cutting line 1. Upon the decrementation of the number $b_n$ determined by the surface defect P1 at a distance $d_1$ from the cutter 26, the data as to the length $L_i$ of movement of the web lo is deleted from the register.

An estimated number of acceptable sheets to be expected within that part of the web 10 extending along the cutting line is expressed by $\{(dl+dc)/e\}-\Sigma b_n$. Accordingly, when the predetermined set number $g_o$ of sheets expressed by the following equation (4) is obtained, the operation control unit 40 provides a stop signal Ts that causes the reel drive 30 to stop the supply reel 12 as well as the rolls 13 and 18. When all of the reel and rolls stop, the operation control unit 40 provides a cut signal Tc that causes the end cutter 16 to cut off that part of the web 10 that extends along the cutting line 1.

$$g_o = b + \{(dl+dc)/e\} - \Sigma b_n \quad (4)$$

where $g_o$ is the desired number of acceptable sheets b is the number of acceptable sheets actually received in pilers 38 and/or 39 dl and dc are the distances shown in FIG. 1 e is the preselected sheet length; and $\Sigma b_n$ is the estimated total number of defective sheets.

The part of the web 10 cut off is continuously advanced in the cutting line 1 and cut to sheets, and the sheets are conveyed and piled into the piler 38 or 39.

The predetermined number $g_o$ of sheets can be expressed as follows:

$$g_o = b + (dg/e) + \{(dl+dc)/e\} - \Sigma b_n \quad (5)$$

where $g_o$ is the desired number of acceptable sheets b is the number of acceptable sheets actually received in pilers 38 and/or 39 dl and dc are the distances shown in FIG. 1 e is the preselected sheet length; and $\Sigma b_n$ is the estimated total number of defective sheets; and where dg is the length by which the web 10 is advanced between the output of $T_s$ from operation control unit 40 and cutting of the web by end cutting shear 16.

Taking the time lag of operation of the operation control unit 40 into consideration, it is desirable to use the following expression:

$$g_o + k = b + (dg/e) + \{(dl+dc)/e\} - \Sigma b_n \quad (6)$$

where k is a correction value according to the time lag. In this case, it is possible to obtain acceptable sheets of a number as close as possible to the predetermined set number $g_o$.

If a surface defect has a length 1, the length $d_1$ in the expression (2) or (3) is replaced by "$d_1 \pm 1$".

Although the present invention has been fully described by way of a particular embodiment thereof with reference to the accompanying drawings, it is to be noted that various changes and modifications will be apparent to those skilled in the art. Therefore, unless otherwise such changes and modifications depart from the scope of the present invention, they should be construed as included therein.

What is claimed is:

1. A control system for a web cutting line in which a web of indeterminate length is cut into sheets, comprising:

cutting means for cutting a web advanced along a web cutting line to sheets of predetermined length;

end cutting shear means disposed near an entrance to said web cutting line for severing that part of said web that extends along said web cutting line from the part of said web that has not yet entered the cutting line;

first defect sensor means disposed near said end cutting shear means for detecting surface defects in said web;

second defect sensing means disposed near said cutting means for detecting defective parts of said web that include a surface defect detected by said first defect sensing means;

control means for estimating the number of acceptable sheets obtainable from said part of said web extending along said cutting line based on the distribution of surface defects detected by said first defect sensing means;

a counter for cumulatively counting acceptable sheets cut off from said web; and said control means also causing said end cutting shear means to cut off said part of said web extending along said cutting line when the sum of said estimated number and said counted number of acceptable sheets reaches a predetermined total.

2. A control system as defined in claim 1, further comprising piling means controlled by said control means on the basis of outputs from said second defect sensing means so as to separately direct acceptable and defective sheets cut off from the web to respective separate pilers.

3. A control system as defined in claim 1, wherein said control means starts an estimation of the number of acceptable sheets obtainable from said part of said web extending along said cutting line when the following equation is satisfied:

$$g_o = b + \{(dl + dc)/e\}$$

where $g_o$ is said predetermined total;

b is the number of sheets having been cut off;

dl is the length of the web between the first and second defect sensing means;

dc is the length of the web between the second defect sensing means and the cutting means; and e is the length of sheet to which the web is to be cut.

4. A control system as defined in claim 3, wherein said estimation of the number of acceptable sheets obtainable from said part of said web extending along said cutting line is performed by use of the following formula:

$$\{(dl + dc)/e\} - \Sigma b_n$$

where $b_n$ is the number of sheets determined defective due to each surface defect detected by the first defect sensing means, said number $b_n$ takes being one if the following formula is satisfied:

$$N.e < d_n < (N+1).e$$

or two if the following formula is satisfied:

$$d_n = N.e$$

where

N is the order of a division of the web in which the detected surface defect exists; and $d_n$ is the distance of the detected surface defect from the cutting means.

5. A control system as defined in claim 4, wherein said control means actuates said end cutter means when the following equation is satisfied:

$$g_o = b + \{(dl + dc)/e\} - \Sigma b_n.$$

6. A control system as defined in claim 4, wherein said control means actuates said end cutter means when the following equation is satisfied:

$$g_o = b + (dg/e) + \{(dl + dc)/e\} - \Sigma b_n$$

where dg is the length by which the web 10 is advanced until the end cutter means is actuated after the output of web stopping signals.

7. A control system as defined in claim 4, wherein said control means actuates said end cutter means when the following equation is satisfied:

$$g_o + k = b + (dg/e) + \{(dl + dc)/e\} - \Sigma b_n$$

where dg is the length by which the web 10 is advanced until the end cutter means is actuated after the output of web stopping signals, and k is a positive number for correction due to time lag of operation of the control means.

* * * * *